US006405921B1

(12) United States Patent
Cochrane

(10) Patent No.: US 6,405,921 B1
(45) Date of Patent: Jun. 18, 2002

(54) PERFORATED CARTON AND PRODUCT DISPLAY SYSTEM

(75) Inventor: Larry Cochrane, Huntsville (CA)

(73) Assignee: Kimberly Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/570,422

(22) Filed: May 12, 2000

(51) Int. Cl.[7] ..... B65D 17/28; B65D 21/032

(52) U.S. Cl. ..... 229/242; 206/503; 229/164; 229/915; 229/918

(58) Field of Search ..... 229/164, 242, 229/915, 918; 206/503, 509, 511, 512, 736, 746, 774

(56) References Cited

U.S. PATENT DOCUMENTS

| | | | | | |
|---|---|---|---|---|---|
| 2,115,673 | A | * | 4/1938 | Stompe | 229/242 |
| 2,822,972 | A | * | 2/1958 | Hartley | 206/503 |
| 3,089,632 | A | | 5/1963 | Bartolucci | |
| 3,161,336 | A | * | 12/1964 | Loescher | 229/242 |
| 3,829,006 | A | * | 8/1974 | Spiegel | 229/242 |
| 3,907,104 | A | | 9/1975 | Taub | |
| 4,116,330 | A | | 9/1978 | Ellis | |
| 4,318,474 | A | * | 3/1982 | Hasegawa | 229/242 |
| 4,350,281 | A | | 9/1982 | Dornbusch et al. | |
| 4,574,945 | A | | 3/1986 | Giblin | |
| 4,584,202 | A | * | 4/1986 | Roccaforte | 229/242 |
| 4,871,067 | A | * | 10/1989 | Valenti | 229/164 |
| 4,946,042 | A | * | 8/1990 | Ferreri et al. | 229/242 |
| 5,156,276 | A | | 10/1992 | Lebowitz | |
| 5,398,869 | A | * | 3/1995 | Dickson et al. | 229/915 |
| 5,555,982 | A | * | 9/1996 | Kuhn et al. | 206/746 |
| 5,645,212 | A | | 7/1997 | Potter | |
| 5,842,576 | A | | 12/1998 | Snow | |
| 5,918,801 | A | | 7/1999 | Milio | |
| 5,957,294 | A | * | 9/1999 | Kanter | 206/774 |

FOREIGN PATENT DOCUMENTS

| | | |
|---|---|---|
| EP | 0919477 A1 | 6/1999 |

* cited by examiner

*Primary Examiner*—Gary E. Elkins
(74) *Attorney, Agent, or Firm*—Dority & Manning, Inc.

(57) ABSTRACT

A perforated carton for displaying products is disclosed. The carton is a multi-sided square or rectangular structure including side panels, a top panel, and a bottom panel. When the carton is torn or separated along pre-cut perforations, a display portion of the carton is provided for display of products nested within the display portion of the carton. The cartons are stackable, and may be arranged in a cluster on a pallet in a configuration that is ready for shipment to a retailer to facilitate display of the pallet or cartons in a shopping area with minimal modification or reconfiguration of the cartons at a retail store site.

16 Claims, 6 Drawing Sheets

PERFORATED CARTON AND PRODUCT DISPLAY SYSTEM

BACKGROUND OF THE INVENTION

In the packaging and display of products, different methods and container apparatus have been used to package and display products in a retail setting. Manufacturers package such goods in a way that will protect the goods during transit to retail stores. For example, it is common for facial tissue to be packaged as forty-eight individual boxes of tissue placed into one shipping carton.

Many products are displayed and marketed in retail stores using free-standing displays in the aisle, instead of being placed upon traditional store shelves. In wholesale shopping clubs, large discount stores and the like, it is common to see large displays of products provided in a floor display. These displays provide numerous cartons or cases of products for purchase by consumers, and often include several shipping cartons stacked in a group. Sometimes, such displays are provided on wooden pallets, where they are dropped by forklifts.

A problem for retailers is that the cartons in which goods are packaged by manufacturers for shipment typically are not also suitable for display of products in a retail setting. In most cases, these shipping-type cartons simply are not capable of displaying individual products for ready and convenient access by consumers. Further, the cartons are usually not attractive from a marketing perspective. Many of these cartons comprise simple six-sided cardboard containers which can be unloaded only by opening the carton, reaching in, and manually removing the products packed inside. It is common for retailers to assemble separate free-standing displays in their retail stores. These free-standing displays may be comprised of corrugated cardboard. Further, such displays generally are provided with attractive advertising. Store personnel sometimes remove products from shipping cartons and place the products into such free-standing displays for retail sale, which is a time consuming task.

With regard to large wholesale stores, products are sometimes specially prepared for shipment to such stores. That is, many manufacturers employ people to specially prepare pallets of "ready to display" products, in contrast to simply shipping the products in the original shipping cartons. Persons hired by the manufacturer unpack cartons which originate from the assembly line, remove the contents, and prepare special displays which are placed on a pallet for stretchwrapping and shipment to retailers. These specially packaged pallets are very desirable for retailers, because they may be placed directly on the floor with a minimal of labor and time required. Once the stretchwrapping material is removed, they are ready for display to consumers without significant further steps or excess manual labor at the retail store.

At least one disadvantage in specially preparing pallets as described is that a large amount of expensive labor is required to unpack products from an original shipping carton and re-pack such products onto a special pallet. Further, it is wasteful for the manufacturer to generate from the assembly line products in a packaged shipping carton, only to have the shipping carton emptied and discarded. It can be very time consuming and expensive to provide products in a ready to display format to retailers. However, retailers prefer such a ready-to-display format.

It would be desirable to devise a container and method of packaging products that will reduce the labor required to prepare products for display by retail stores. Further, a method, system, and apparatus that avoids undesirable waste of shipping containers, and provides a convenient and easy to use display method, would be advantageous.

SUMMARY OF THE INVENTION

The present invention recognizes and addresses the foregoing drawbacks and deficiencies of prior art constructions and methods. Accordingly, a perforated carton is provided comprising a plurality of side panels, a top panel, a bottom panel, and perforations along the surface of one or more of said panels. The perforations generally are adapted for separation of the carton into portions. A perforated carton may be provided in which the carton is divided by perforations into a display portion and a discardable portion. The carton also may include a display portion which is configured to reveal the contents of the carton upon separation of the carton at the perforations.

The carton may include a plurality of corners located at panel intersections, wherein the display portion of the carton comprises a majority of such corners as compared to the discardable portion of the carton. In some embodiments, the carton comprises about eight corners.

A perforated carton is also disclosed which comprises four side panels, a top panel, and a bottom panel, wherein the panels coordinate to form a total of eight corners on the carton. The carton further includes perforations along the surface of one or more of said panels, wherein the carton may be separated along the perforations into a display portion and a discardable portion, the display portion of the carton including at least six of said eight corners.

Further, the perforations may be provided along the top panel of the carton such that when the carton is separated into a discardable portion and a display portion, the display portion of the carton comprises at least two corners in the plane of the top panel. The carton is also provided which includes, in the display portion of the carton, at least some amount of the top panel which existed prior to separating the carton at the perforations.

In some embodiments, a carton is provided that includes a display portion of the carton for supporting the weight of a second shipping carton upon its top panel when placed in a stacked configuration. The carton also may include a display portion which is provided with four corners in the plane of its top panel. The carton also may include side panels on the display portion of the carton that are adapted to reveal the contents of the carton upon separation of the carton at the perforations. The carton also may include at least four corner posts which serve to support weight of additional cartons on an upper surface of a carton.

One aspect of the invention also includes a pallet comprising a plurality of perforated cartons having four side panels, a top panel, and a bottom panel. In most cases, the side panels, top panel, and bottom panel coordinate to form a total of about eight corners on the carton. Further, perforations along the surface of one or more of the panels are provided. The carton may be separated along the perforations into a display portion and a discardable portion. Further, the display portion of the carton will, in some embodiments, include at least six of said eight corners. The perforations are provided along the top panel of the carton such that when the carton is separated into a discardable portion and a display portion, the display portion of the carton comprises at least two corners in the plane of the top panel. In some embodiments, a flat support is provided that is capable of supporting the weight of the cartons. The cartons are stacked for display on the flat support. In one embodiment, a pallet contains at least some perforated cartons which are separated along perforations into a discardable portion and a display portion.

BRIEF DESCRIPTION OF THE DRAWINGS

A full and enabling disclosure of this invention, including the best mode shown to one of ordinary skill in the art, is set forth in this specification. The following Figures illustrate the invention.

DETAILED DESCRIPTION OF THE INVENTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

A die cut perforated carton is provided which offers significant advantages and benefits over cartons of the prior art. The invention is provided in several embodiments, but generally offers a method and apparatus for displaying finished consumer products in a perforated carton without requiring the consumer products to first be manually removed from manufacturing cartons and placed in separate display cartons. Thus, the perforated carton is capable of serving as a normal production and shipping carton for goods which will not be displayed using cartons at all (i.e. goods that will be stocked on shelves). Further, the perforated carton can be easily modified, without removing the goods therein, to display the goods, if desired, by a re-packer, manufacturer, or retailer. Further, the carton may be modified and combined with other cartons to prepare a ready-to-display pallet for a floor display.

Figure 1:
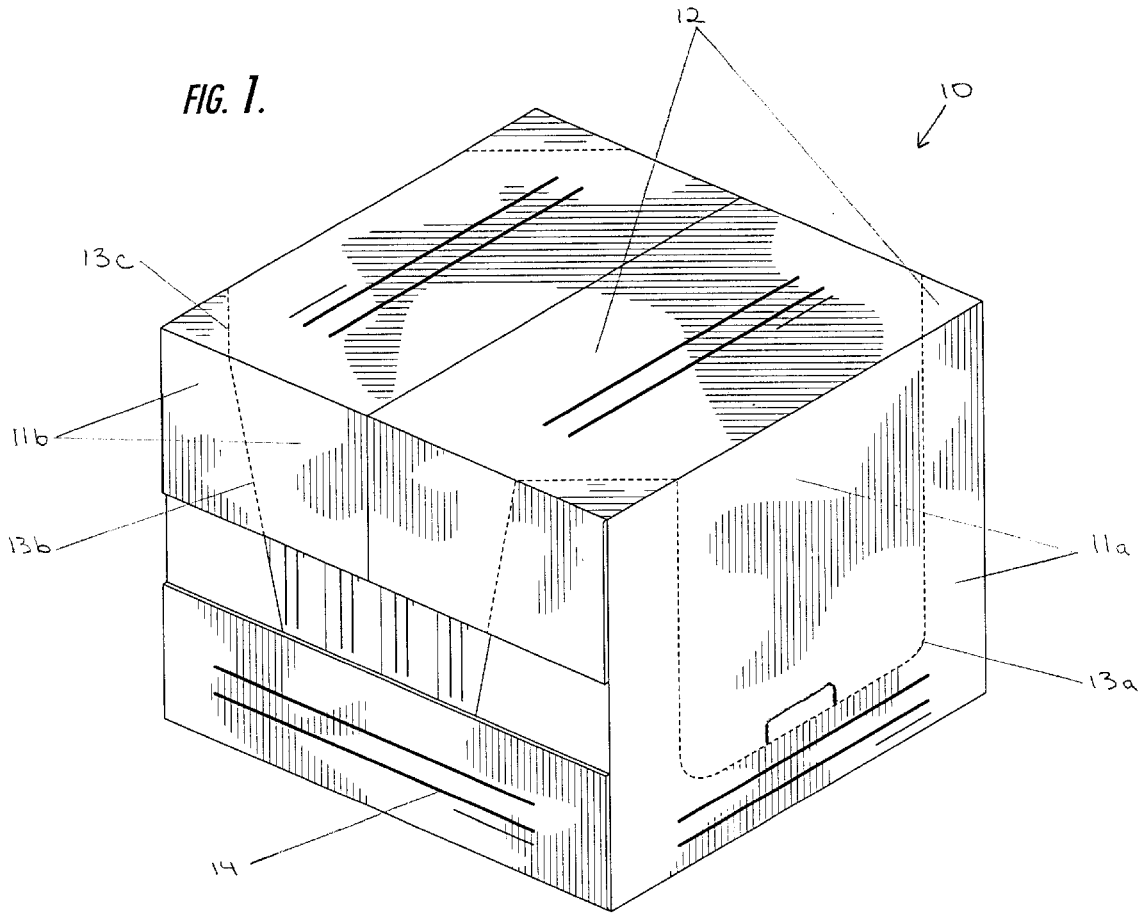
FIG. 1 is a perspective view of a perforated carton of the invention.

Turning now to FIG. 1, a perforated carton 10 is shown with side panels 11*a* and 11*b*. Side panels 11*c* and 11*d* are hidden from view and therefore not shown in FIG. 1. A top panel 12 is shown near the top of the FIG. 1. A bottom panel 15 is not shown in FIG. 1, but may be seen in FIG. 7. Perforations are provided in a continuous line around the carton as seen by example with perforations 13*a*, 13*b*, and 13*c*. Perforations can be placed at any location on the panels that provides a convenient separation point for the carton. Advertising insignia 14 may be placed on the exterior of the carton to draw consumer attention to the products displayed in the carton.

Figure 2:
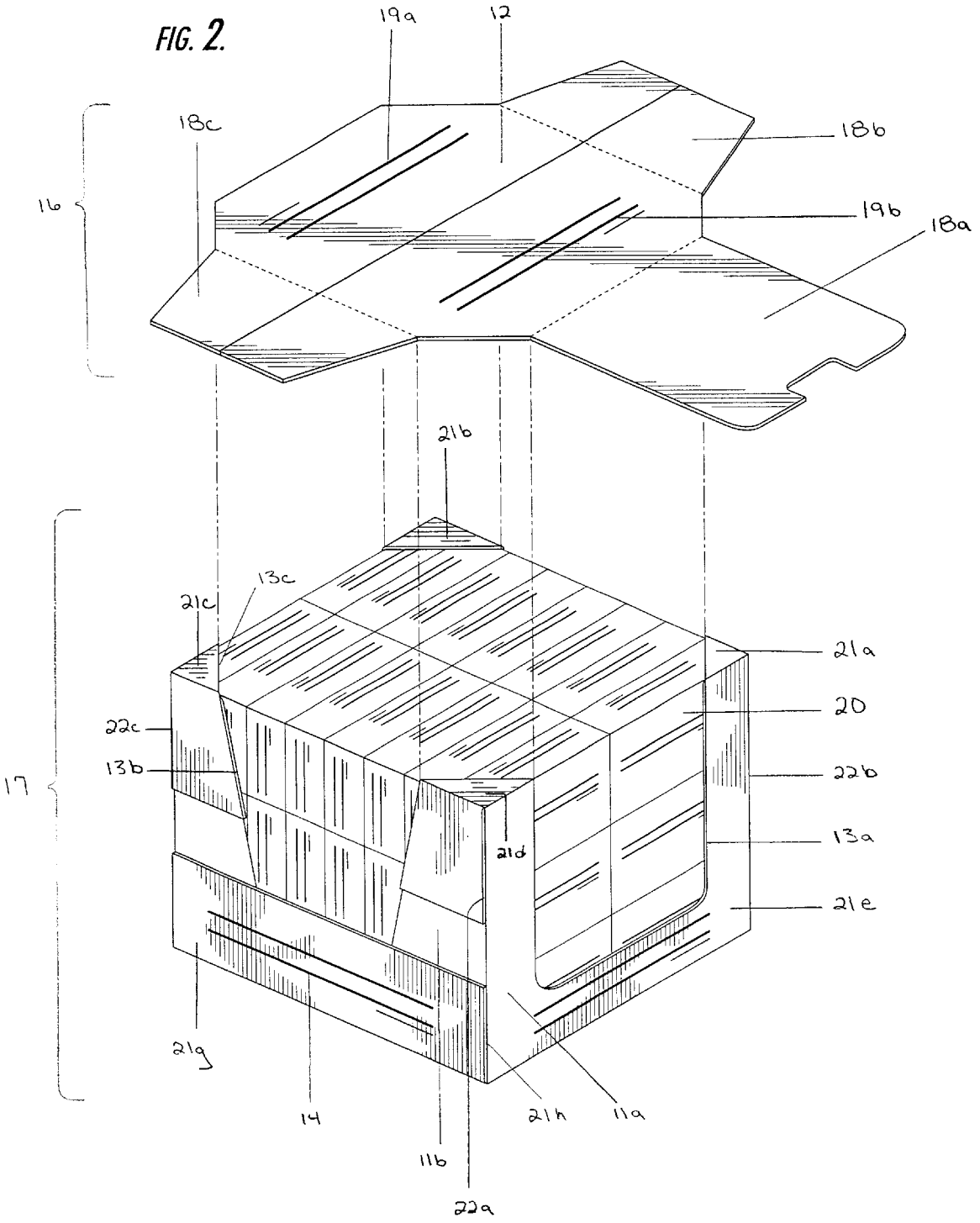
FIG. 2 shows an exploded perspective view of the perforated carton of the invention, wherein the carton has been separated at perforations into a discardable portion (above) and a display portion (below)

The perforated carton 10 may be torn (and thereby divided) as seen in FIG. 2 into a discardable portion 16 and a display portion 17. The division is preferably accomplished by separating the carton material at the perforated seams, such as along perforations 13*a*, 13*b*, and 13*c*. A flap 18*a* may be lifted upwards, while other flaps 18*b* and 18*c* are raised vertically and separated from their respective side panels. One preferred embodiment utilizes cardboard as the carton material, but other materials could be used as well. Generally, any material capable of sustaining perforations which are separable can be used as the carton material.

Marketing insignia 19*a* and 19*b* provide product logo or identifying information which can be viewed when the carton is in the undivided mode of operation as in FIG. 1. Further, boxed products 20 can be seen by consumers when the carton is in the display mode, that is, when the carton has been separated as shown in FIG. 2. Any goods may be utilized in the practice of the invention, and it is not required that the goods be rectangular or square in shape. In fact, the goods need not be symmetrical at all, and FIG. 2 illustrates merely one example of goods which may be employed. In FIG. 2, the products shown are boxes of facial tissues, but almost any conceivable product that is capable of shipment in cartons could be employed in the practice of the invention.

Corners 21*a*–21*h* are provided at the edges of the carton where three planes meet (i.e. two side panels and a top panel, or two side panels and a bottom panel). Corner 21*f* cannot be seen in FIG. 2. Corner posts are formed when the carton is in the display mode, as shown by the four corner posts (22*a*, 22*b*, 22*c* and 22*d*) of display portion 17 of the perforated carton shown in FIG. 2. The corner posts provide strong vertical support for carton placed in the display mode, and they allow for stacking of cartons that are in the display mode. In FIG. 2, the carton is comprised of a display portion in which four corners (i.e. 21–*d*) are provided in the plane of the top panel 12 which has been removed.

Figure 3:
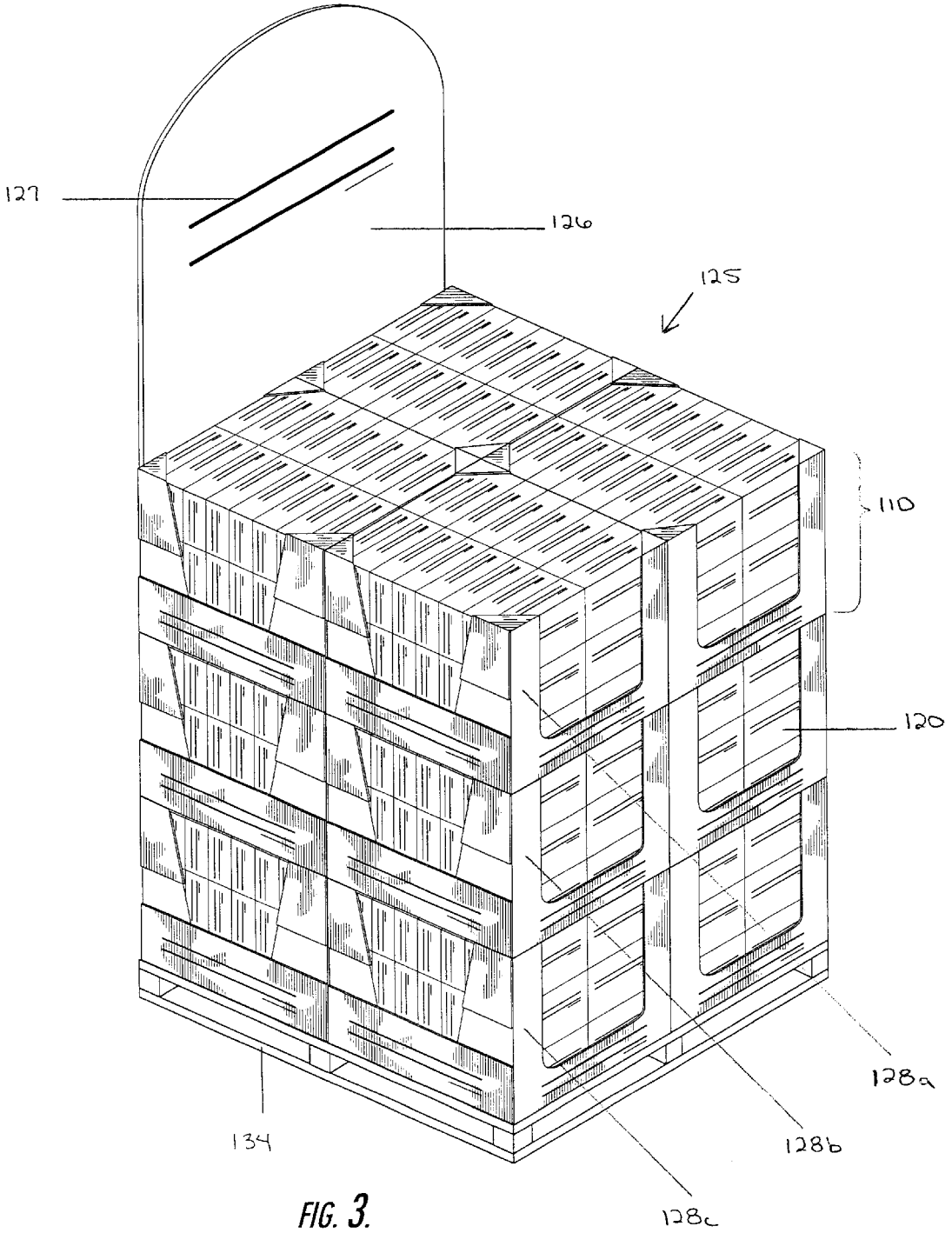
FIG. 3 shows a perspective view of one embodiment of the invention in which multiple perforated cartons are stacked and combined to form a pallet in a floor display.

FIG. 3 shows one alternative embodiment of the invention of a pallet 125 that employs multiple perforated cartons 110 stacked three high in four stacks. A total of twelve perforated cartons are used in this particular display, although any combination or number could be used in the practice of the invention. Products 20 can be seen by consumers since the perforated cartons are all in the display mode. The cartons reveal only the display portions because the discardable portion has been removed from each perforated carton. An advertising header card 126 having an advertising message 127 may be erected upon the pallet once it is placed on the floor for display by a retailer. The header card 126 may be shipped with the pallet under a cover (seen in FIG. 4), and then erected as seen in FIG. 3. Corner posts 128*a*–*c* provide strong vertical support for the cartons, while the cartons are in the display configuration. Wooden support 134 provides a platform for the cartons, and may be engaged by a forklift or other lifting device to facilitate easy transport of the display. In most cases, each carton is capable of supporting at least two additional cartons on its top panel (upper surface), even when in the display (torn) mode.

Figure 4:
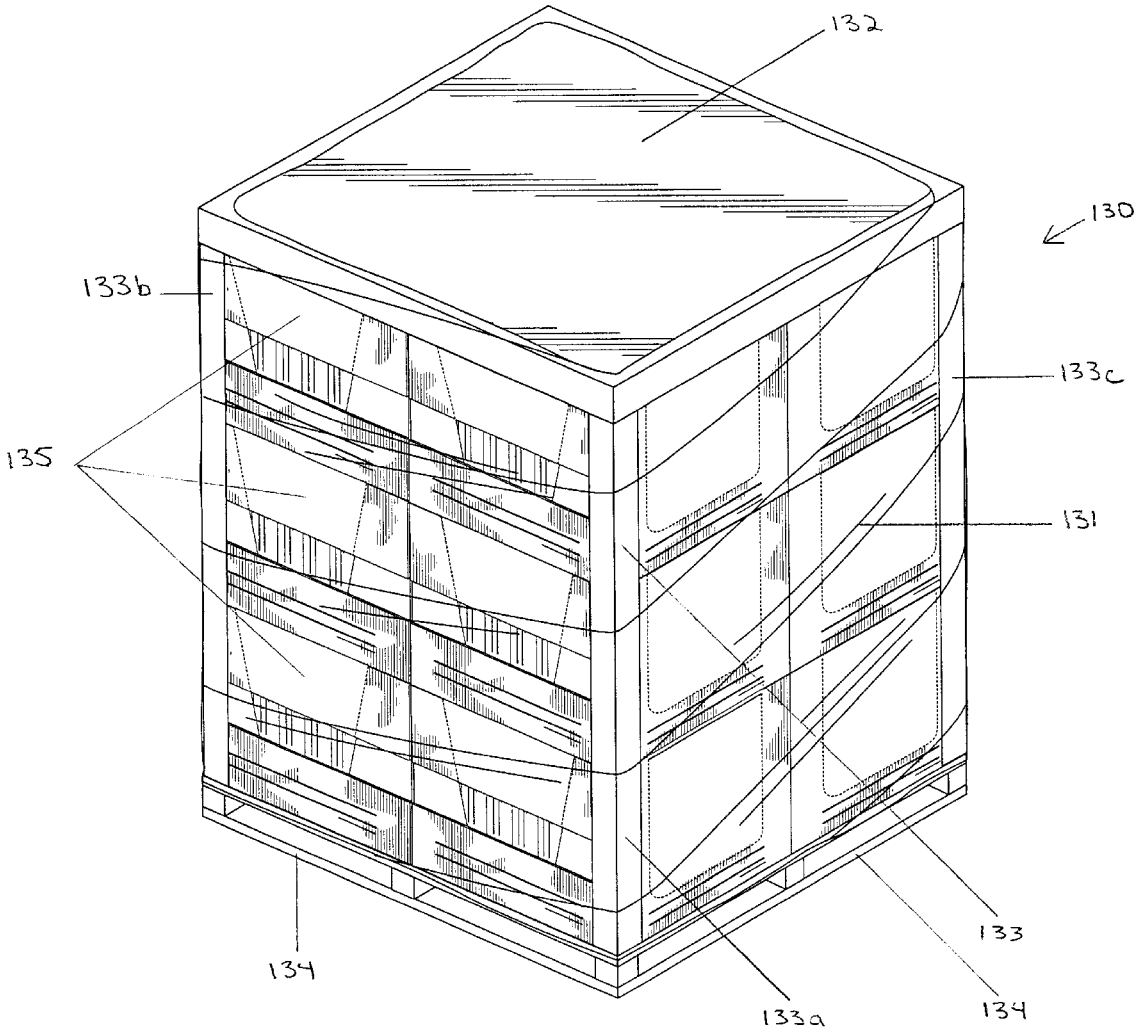
FIG. 4 shows a perspective view of a wrapped and packaged pallet ready for shipment.

FIG. 4 shows a wrapped pallet 130 readied for shipping to a store, such as a large discount store. The wrapped pallet is suitable for placing on an aisle using a forklift or other lifting means. Perforated cartons are placed in the display mode by removing discardable portions of the cartons. The cartons 135 are stacked, and disposable posts 133*a*–133*d* are provided to steady and contain the perforated cartons on their edge (133*d* is not seen in FIG. 4). The posts 133*a*–*d* are temporary, for shipping purposes, and are held in place by clear stretchwrap material 131 which is placed around the circumference of the wrapped pallet. Cover 132 is placed on top of the perforated cartons, and also serves to hold in place the posts 133*a*–133*d* at each corner of the pallet. This pallet allows cartons from the manufacturing line to be torn at their respective perforations, the discardable portions thrown away, and the products readied for display, all performed at the manufacturing or packaging site. Thus, it requires very little effort from the stock clerks at the retail store to ready the pallet for consumer display. Once the wrapped pallet is placed on the floor, and the cover 132 and wrapping material 131 is removed, then the advertising header card 126 is erected as shown in FIG. 3. Wooden support 134 serves as a platform for the perforated carton display.

Figure 5:
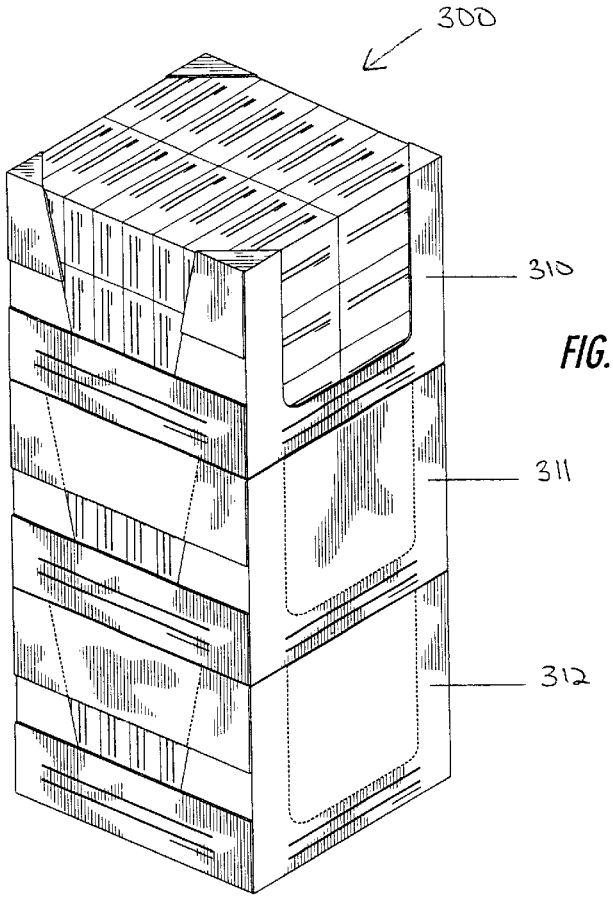
FIG. 5 is a perspective view of an alternative configuration of stacked perforated cartons.

In FIG. 5, a configuration is shown which comprises an alternative stacked configuration 300 that uses perforated cartons 310, 311 and 312 stacked in a single column, as might be used in a pharmacy or small retail store. In this embodiment, the stock clerk would provide the carton on top of the stack, i.e. carton 310, in a display mode using only the display portion of the carton 310. This would be done by tearing away the discardable portion of carton 310. Then, the cartons 311 and 312 could be torn into the display mode at a later time when the top carton 310 was emptied. While the carton 310 is not yet empty, the cartons 311 and 312 serve as effective advertising by having in place their discardable portions which are not torn, but still intact. The cartons 311 and 312 typically would have advertising messages printed on their exterior. The average width or size of the configuration in FIG. 5 typically would be about 1–2 feet on each side, and would easily fit in an aisle of a small convenience store. However, this invention is not limited by any particular linear dimension of the cartons. In the configuration shown in FIG. 5, the perforated cartons would most likely be shipped to the convenience store using the carton configuration as seen in FIG. 1.

Figure 6:
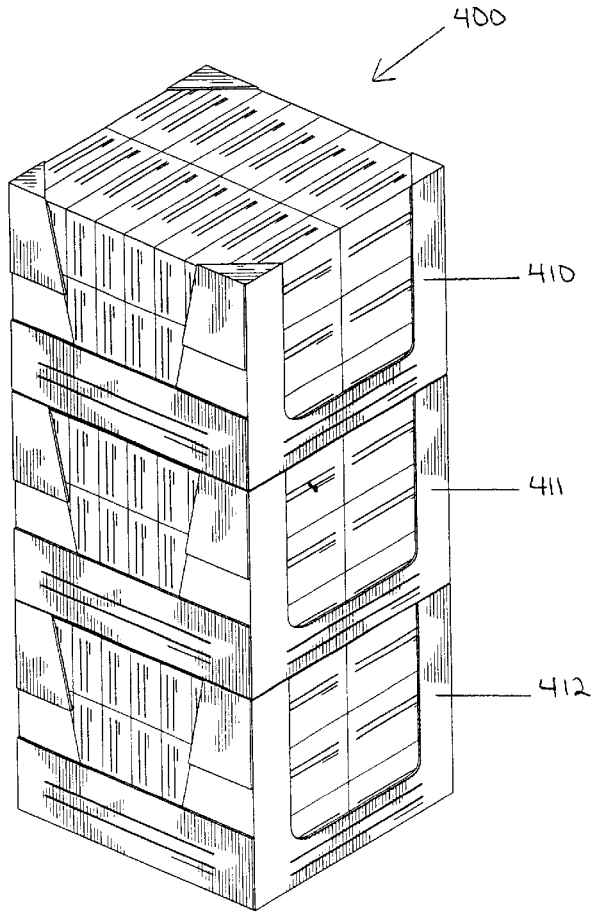
FIG. 6 shows an alternative configuration of perforated stacked cartons.

FIG. 6 shows an alternate configuration in which a stacked configuration 400 employs cartons 410, 411, and 412. This configuration may be used in a retail store with a relatively high volume, i.e. for example, when a carton could be emptied by consumers in less than the time interval in which stock clerks re-configure their stock. Thus, the cartons could all be separated into display portions and stacked for display, and no stock clerk assistance would be necessary for the product to be sold completely to consumers without further intervention by a stock clerk. In this configuration, the products themselves serve as an advertising medium, since the boxes of product are visible to consumers along the height of the display.

Figure 7:
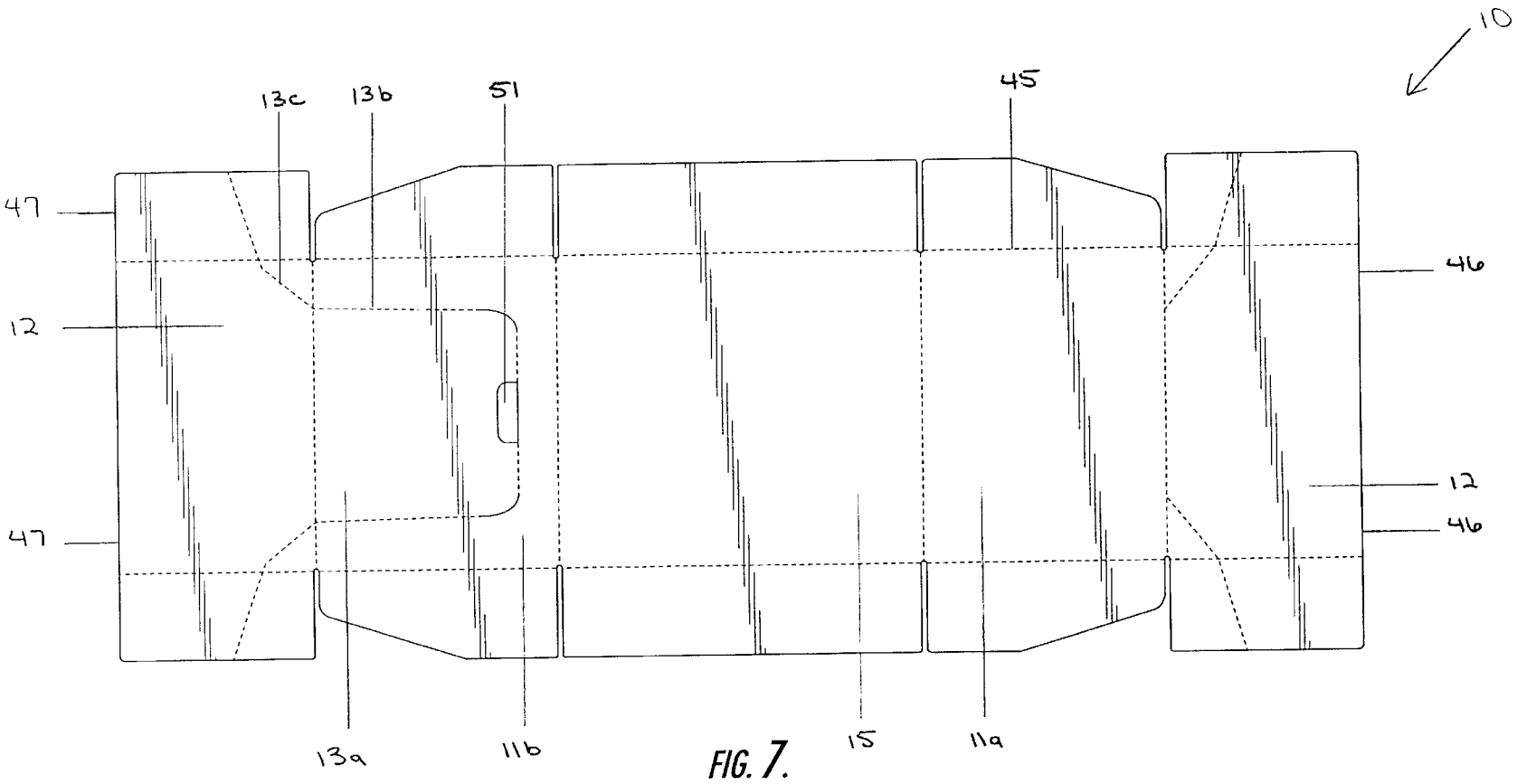
FIG. 7 is a two-dimensional layout showing a flat perforated carton which has not yet been machine folded into a carton such as in FIG. 1.

FIG. 7 shows a two dimensional layout of the perforated carton of FIG. 1. In FIG. 7, the perforation line can be seen as 13*a*, 13*b* and 13*c*. Handle 51 optionally provides a means to begin the perforation separation step using fingers or by inserting a device into the carton. Side panel 11*b* is adjacent to top panel 12. Bottom panel 15 and side panel 11*a* also are shown adjacent to top panel 12. The top panel is split, and appears at both sides of FIG. 7 at opposite ends of the flat carton of FIG. 7. The top panel 12 is joined along glue lines 46 and 47 when the carton is assembled.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A perforated carton adapted for transporting and displaying products, comprising:

(a) a plurality of side panels, (b) a top panel having four top corners and defining between said four top corners a display area along a plane of the top panel, (c) a bottom panel, and (d) perforations along the surface of at least two of said panels, the perforations being adapted for separation of the carton into:

i) a display portion that is substantially unobstructed in the display area of the plane of the top panel and extending into at least one of the side panels, and ii) a discardable portion;

iii) wherein, when the carton is separated, the only portion of the carton remaining in the top panel is one or more top corners formed respectively at the intersection of two of the side panels and the top panel.

2. The carton of claim 1 in which the display portion of the carton is configured to reveal the contents of the carton upon separation of the carton at the perforations.

3. The carton of claim 1 in which the carton further includes a plurality of bottom corners located in the plane of the bottom panel and adjacent to the plurality of side panels.

4. The carton of claim 3 in which the display portion of the carton includes eight total corners.

5. The carton of claim 3 in which the display portion of the carton includes a total of at least 6 corners.

6. The carton of claim 4 in which the display portion of the carton includes a total of at least seven corners.

7. A perforated carton, comprising:

(a) four side panels, (b) a top panel comprising a substantially horizontal top plane, (c) a bottom panel, wherein said side panels, top panel, and bottom panel coordinate to form (i) four top corners formed at the respective intersections of two of the side panels and the top panel, upon the horizontal top plane, and (ii) four bottom corners located at the intersection of the bottom panel with the four side panels;

(iii) wherein said four top corners lie in the top plane, and (d) perforations along the surface of at least two of said panels, wherein the carton is configured to be separated along the perforations into a display portion and a discardable portion, wherein the display portion comprises a display area extending along the top panel and also upon at least one of said side panels, and wherein the top plane of the carton, when the carton is separated along its perforations, comprises a substantially unobstructed surface area bounded by said four remaining top corners, the top plane of the carton being substantially removed when the carton is separated along said perforations, the removal applying to substantially the entire top plane excepting the top four corners.

8. The carton of claim 7 in which the display portion of the carton is capable of supporting the weight of a second shipping carton upon its top panel when placed in a stacked configuration.

9. A perforated carton, comprising:

(a) four side panels, (b) a top panel, (c) a bottom panel, wherein said side panels, top panel, and bottom panel coordinate to form a total of about eight corners on the carton, (d) perforations along the surface of at least two of said panels, wherein the carton may be separated along the perforations into a display portion and a discardable portion, the display portion of the carton including at least six of said eight corners, and (e) further wherein the perforations are provided along the top panel of the carton such that when the carton is separated into a discardable portion and a display portion, the display portion of the carton comprises at least two corners which are located in the plane of the top panel, and (f) wherein the side panels on the display portion of the carton are adapted to reveal the contents of the carton upon separation of the carton at the perforations.

10. The carton of claim 9 in which the display portion of the carton includes at least four corner posts.

11. A perforated carton, comprising:

(a) four side panels, (b) a top panel, and (c) a bottom panel, wherein the planes of said respective side panels, top panel, and bottom panel coordinate to form a total of eight corners on the carton, (d) wherein the eight corners are provided in an aligned and paired configuration so as to form four posts, wherein corners are located at both ends of each post at the intersection of two side panels with either (1) the bottom panel, or (2) the top panel, such that the posts are oriented generally perpendicular to the plane of the top panel, wherein the plane of the top panel includes a first surface area generally between said posts, (e) perforations along the surface of the top panel, wherein the carton may be separated along the perforations into a configuration which is a display portion and a configuration which is a discardable portion, wherein said display portion extends along the top plane and also into at least one of said side panels, the display portion providing a substantially unobstructed first area bounded by four posts when separated, and (f) wherein the posts of the display portion of the carton are adapted to support weight applied to the top panel when the carton is in the separated configuration.

12. The carton of claim 11 in which the weight that the carton is capable of supporting is at least equal to the weight of a fully loaded carton.

13. The carton of claim 11 in which the weight that the carton is capable of supporting is at least equal to about twice the weight of a fully loaded carton.

14. The carton of claim 11 in which the weight that the carton is capable of supporting is at least equal to about three times the weight of a fully loaded carton.

15. A pallet comprising:

(a) a plurality of perforated cartons, at least one carton having (i) four side panels, (ii) a top panel having four top corners in a plane and a first surface area between said top four corners and in said plane, (iii) a bottom panel, wherein said side panels, top panel, and bottom panel coordinate to form a total of about four top corners and four bottom corners on the carton, said top corners being formed at the intersection of two of said side panels with said top panel, said bottom corners being formed at the intersection of two of said side panels with said bottom panel, said four top corners being each connected, respectively, with the four bottom corners by four posts, (iv) perforations along the surface of one or more of said panels, wherein the carton may be separated along the perforations into a display portion and a discardable portion, the display portion extending into at least one of said side panels, (v) further wherein the perforations are provided along the top panel of the carton such that when the carton is separated into a discardable portion and a display portion, the display portion of the carton comprises at least two corners in the plane of the top panel, further wherein upon said separation, the display portion is substantially unobstructed except for one or more top corners lying in said top plane; and (b) a flat support that is capable of supporting the weight of said cartons, wherein the cartons are stacked for display on the flat support.

16. The pallet of claim 15 in which at least some of the perforated cartons are separated along perforations into a discardable portion and a display portion.

* * * * *